US005678275A

United States Patent [19]

Derfner

[11] Patent Number: 5,678,275

[45] Date of Patent: Oct. 21, 1997

[54] TOOTHBRUSH WITH BRISTLES HAVING INTERMEDIATE ROUGHENED PORTION

[76] Inventor: Nitza Derfner, 860 Hobart St., Menlo Park, Calif. 94025

[21] Appl. No.: 753,170

[22] Filed: Nov. 20, 1996

Related U.S. Application Data

[63] Continuation-in-part of Ser. No. 497,547, Jun. 30, 1995, abandoned.

[51] Int. Cl.[6] ..... A46B 9/04

[52] U.S. Cl. ..... 15/167.1; 15/207.2

[58] Field of Search ..... 15/167.1, 207.2, 15/DIG. 6; 428/400, 401

[56] References Cited

U.S. PATENT DOCUMENTS

| | | | |
|---|---|---|---|
| 2,110,371 | 3/1938 | Radford | 15/207.2 |
| 3,698,405 | 10/1972 | Walker | 15/207.2 |
| 4,373,541 | 2/1983 | Nishioka | 15/207.2 |
| 4,471,505 | 9/1984 | Spademan | 15/167.1 |
| 4,534,081 | 8/1985 | Spademan | 15/167.1 |

FOREIGN PATENT DOCUMENTS

| | | | |
|---|---|---|---|
| 3116189 | 12/1982 | Germany | 15/167.1 |

*Primary Examiner*—David Scherbel
*Assistant Examiner*—Terrence Till

[57] ABSTRACT

A toothbrush (10) has a head portion (14) with a plurality of individual bristles (16) wherein each bristle consists of a smooth stabilizing post (22) which is rigidly attached to the head portion, a smooth tip (18) at a free end of the bristle, and a roughened intermediate portion (20) or portions between the stabilizing post (22) and the smooth tip portion (18). The roughened portions are made in the form of grooves (26) produced by squeezing the bristles between several pairs of die plates such as (40*a*), (40*b*) and (42*a*), (42*b*), etc. In a squeezed state of the bristles one die plate of the pair is moved in a longitudinal direction. At the same time, the toothbrush is turned back and forth with respect to now-stationary die plates which are maintained in a bristle-squeezing state. As a result, grooves or knurlings which extend in a circumferential direction of the bristles are formed on the side surfaces of the bristles.

14 Claims, 4 Drawing Sheets

TOOTHBRUSH WITH BRISTLES HAVING INTERMEDIATE ROUGHENED PORTION

This is a continuation-in-part of application Ser. No. 08/497,547, filed Jun. 30, 1995 now abandoned.

BACKGROUND

1. Field of the Invention

The present invention relates to a toothbrush, more particularly, to a novel toothbrush with partially roughened or knurled bristles. The invention also relates to a method of manufacturing such toothbrushes.

2. Prior Art

Brushing of the teeth is universally recommended as the most effective way to maintain oral hygiene. A toothbrush remains the most widely-used, suitable and inexpensive tool for cleaning teeth and gums and preventing tooth decay.

At the present time many different types of toothbrushes are known and exist on the market. They are available in a great variety of shapes, dimensions, colors, configurations, etc. In general, however, each toothbrush consists of a handle, a head, and a plurality of bristles. Each bristle is attached at one end to the head of the toothbrush and the free ends of the bristles form a cleaning surface for the teeth.

A majority of existing toothbrushes have bristles of a uniform and smooth nature. One such toothbrush is described, e.g., in U.S. Pat. No. 5,120,225 issued in 1992 to N. Amit.

A toothbrush with uniform and smooth bristles is disadvantageous in that during tooth cleaning the smooth sides of the bristles slide over the surfaces of teeth, thus not being able to provide effective cleaning. Furthermore, because of this sliding effect smooth bristles cannot perform microscopic cleaning and removing of microscopic tartar which may cause gum diseases.

Attempts have been made to solve this problem by splitting the ends of the bristles into a plurality of branches. Such a toothbrush, which is disclosed, e.g., in U.S. Pat. No. 3,295,156, issued in 1967 to J. Brant, et al., has a plurality of synthetic fiber bristles with one end of each bristle being connected to the head portion of the toothbrush. A part of each bristle is split longitudinally at the free end to about 20 to 80% of the bristle length. The rest of the bristles, which are shorter than the split ones, remain intact.

A disadvantage is that the branches, which have been formed by splitting, are very thin and flexible. Therefore they produce a sweeping, rather than brushing and scraping effect, on the surfaces of the teeth. Moreover, because of extreme flexibility and softness, thin branches or flags cannot penetrate cavities between the teeth or enter spaces underneath the bridges. They also cannot clean teeth with braces and will have a very short service life as they will get caught by braces, broken, or torn and lost after a short usage. Apart from the cleaning effect, the intact or so-called unflagged bristles are identical to smooth bristles and are used to support the branches or flags from separation and falling apart. However, as far as the cleaning effect is concerned, they have the same disadvantages as any smooth bristles.

It has also been proposed to improve the cleaning ability of a toothbrush by using bristles with roughened surfaces. An example is described in U.S. Pat. No. 5,228,753, issued in 1993 to H. Klein. Each bristle of this toothbrush is continuously roughened over its entire exterior surface. Roughening is performed on a stretched endless fiber strand by mechanical action, e.g., by blasting with an abrasive material, or by chemical action. After roughening, the fiber is cut into separate bristles which are then inserted into a toothbrush and fixed in the toothbrush head.

Although such toothbrushes demonstrate an improved tooth cleaning effect as compared to brushes with smooth or split bristles, they still entail some disadvantages. First of all, a roughened tip cannot easily penetrate small cavities without deformation or bending. Therefore they quickly become soft and loose their cleaning efficiency. Second, the continuous roughening of each bristle to some extent weakens the entire bristle, making it less rigid, whereby, when the bristle is pressed against the tooth surface with hand pressure, the entire bristle will fold over. Moreover, the process of roughening a continuous filament (which is later cut into separate bristles) or precut bristles prior to assembling them into a toothbrush does not give an opportunity for a toothbrush designer to differentiate or control functions of different parts of the bristles for more effective cleaning.

OBJECTS OF THE INVENTION

Several objects of the present invention to provide a toothbrush with partially knurled bristles which have an improved tooth cleaning capacity, do not slide over the surfaces of teeth during cleaning, perform cleaning and removing of microscopic tartar-creating bacteria, produce a brushing and scraping effect rather than a sweeping effect, impart higher rigidity to the bristle tips, facilitate penetration of bristles into cavities around the teeth and underneath the bridges without snagging, facilitate cleaning of teeth with braces, are resistant to the loss of bristles after short usage, and have an improved rigidity. Another object of the invention is to provide a method for manufacturing toothbrushes of the aforementioned type while controlling functions of different parts of the bristles for more effective cleaning.

Other objects and advantages of the present invention will become apparent after the consideration of preferred embodiments thereof with reference to the attached drawings.

BRIEF DESCRIPTION OF THE DRAWINGS

FIGS. 1–3—DETAILED DESCRIPTION OF THE TOOTHBRUSH OF THE INVENTION

Figure 1:
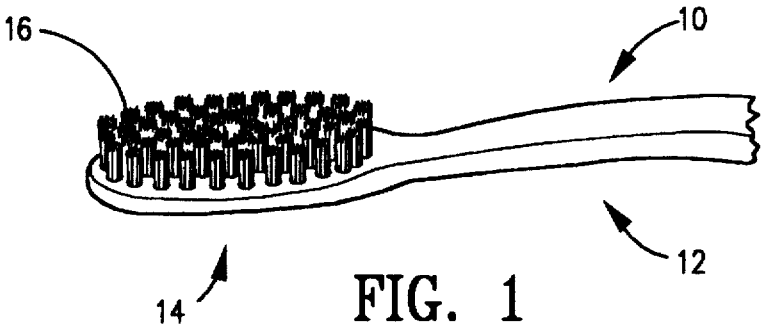
FIG. 1 is a perspective general view of a brush of the present invention.

A toothbrush of the present invention is shown in FIG. 1, a perspective view. It can be seen that in general the toothbrush 10 is very similar to a conventional toothbrush and consists of a handle 12 and a head portion 14 which supports a plurality of bristles 16 fixed at one end to head portion 14.

Figure 2:
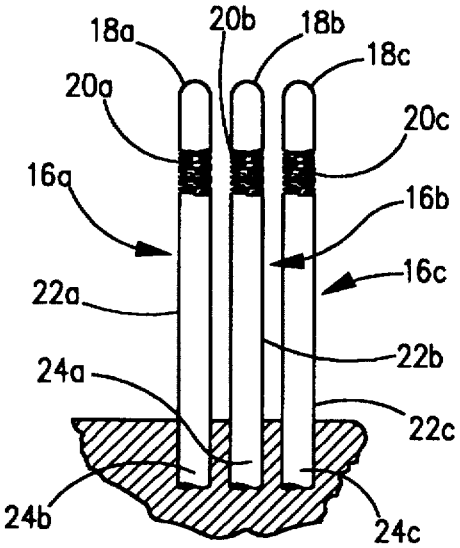
FIG. 2 is a fragmental, partially sectional view of the toothbrush head illustrating the configuration of the bristles.

A distinctive feature of the toothbrush is the configuration of bristles 16 which are shown in more detail in FIG. 2. This figure is a fragmental, partially sectional view of head portion 14 illustrating the configuration of bristles 16. For simplicity of the drawing the bristles are shown as embedded into the head of the brush separately. However in reality several bristles are grouped together which further contributes to their strength and rigidity.

As can be seen from FIG. 2, bristles 16*a*, 16*b*, 16*c* . . . consist essentially of three parts, i.e., a smooth rounded tip 18*a*, 18*b*, 18*c* . . . , a serrated knurled, grooved, or roughened intermediate portion 20*a*, 20*b*, 20*c* . . . , and a smooth supporting and stabilizing portion or posts 22*a*, 22*b*, 22*c* . . . The ends 24*a*, 24*b*, and 24*c* . . . of supporting portions 22*a*, 22*b*, 22*c* . . . are fixed, e.g., embedded into the material of head portion 14 of toothbrush 10.

The bristles of the invention have a predetermined diameter, and have the same length as those of a conventional toothbrush. That is, the diameter of the bristles of the invention seen in FIG. 2, for example, remain essentially constant over the entire length of the bristle, i.e., the smooth base portions 22*a*, 22*b*, 22*c*; the roughened or knurled portions 20*a*, 20*b*, 20*c*; and the smooth tip portions 18*a*, 18*b*, 18*c*.

The function of tip portions is to guide the bristles into the tooth cavities, spaces between the teeth, under the gum, under the bridges, unfit caps, or other difficult-to-reach areas, especially in the back of the mouth. The tips are relatively rigid and have the same diameter as stabilizing posts 22*a*, 22*b*, 22*c* . . . .

Figure 2A:
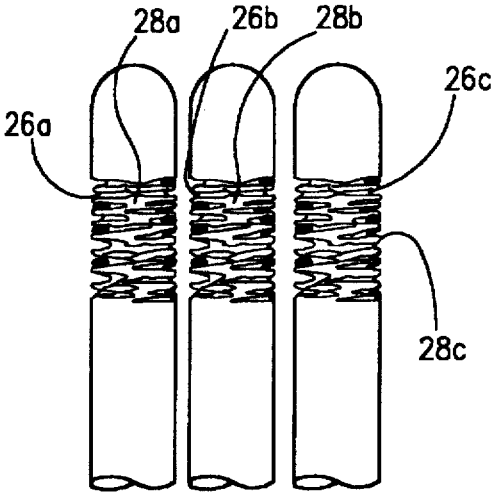
FIG. 2A is a fragmental view of a bristle illustrating a serrated portion on a larger scale.

The intermediate knurled portions may be of any suitable size, as long as they do not cover the entire bristle, but in general, they are of about 1/10 to 3/4 of the length of the entire bristle. As shown in FIG. 2A, which is a partial view of the bristle illustrating the knurled portion on a larger scale, the bristles have a multitude of adjacent serrations or grooves 26*a*, 26*b*, 26*c* . . . formed all around the bristle periphery. Each groove is directed circumferentially of the bristle surface but occupies only a part of the circumference. In other words, grooves 26*a*, 26*b*, 26*c* . . . do not form closed loops and leave between them intact portions 28*a*, 28*b*, 28*c* . . . . Intact portions are left also in the longitudinal direction of the bristles. The edges of the lands or intact portions between grooves 26*a*, 26*b*, 26*c* . . . function as microscopic scrapers, and intact portions 28*a*, 28*b*, 28*c* impart to knurled portions 20*a*, 20*b*, 20*c* . . . strength and resistance to breakage. In order to ensure sufficient scraping action and provide projections formed by intact portions 28*a*, 28*b*, 28*c* . . . between grooves 26*a*, 26*b*, 26*c* . . . with rigidity, the grooves should have a depth of about 1/10 to 1/3 of the bristle thickness. The distances between the grooves or serrations, i.e., the widths of intact portions or projections (lands) 28*a*, 28*b*, 28*c*, . . . may vary from 0 to 3 mm and should not be less than the depth of the grooves, i.e, should exceed the depth of the groove. If grooves 26*a*, 26*b*, 26*c* . . . are arranged closer to each other than specified above, and are deeper than specified above, the projections formed between them will be soft and will produce a wiping, rather than a scraping action.

More specifically, the surface coefficient, i.e., the ratio of the surface occupied by the grooves to the entire surface of the bristle, may vary between 5 to 90%. As can be shown later in the description of the method of manufacturing the toothbrush, this ratio can be easily controlled, as well as the length of knurled portion.

Figure 2B:
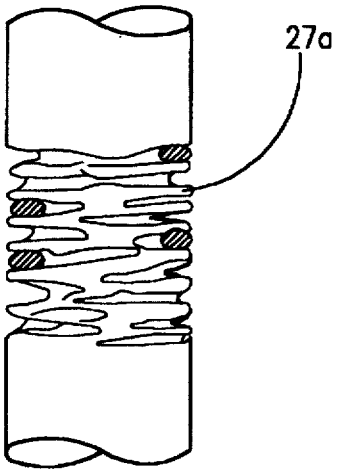
FIG. 2B is a fragmental view of a bristle with long serrations or grooves on its side surfaces.

As shown in FIG. 2B, the grooves may be knurled deeper to such a depth that they leave longer projections between them, such as projections 27*a*. Such projections are located closer to each other than in the case of grooves 26*a*, 26*b*, 26*c*. In this case, to impart higher rigidity, the bristles should be thicker or made of a more rigid plastic. In toothbrushing, these projections are able move back and forth and thus to entrap microscopic food particles and produce a self-cleaning effect, which will be shown later in the description of operation.

Stabilizing posts 22*a*, 22*b*, 22*c* occupy the remaining part of bristles and function as supporting and stabilizing elements for tips 18*a*, 18*b*, 18*c* . . . and serrated or grooved intermediate portions 20*a*, 20*b*, 20*c* . . . . Stabilizing posts 22*a*, 22*b*, 22*c* have smooth intact surfaces, i.e., they are free of any roughened or knurled portions which may impair their strength and rigidity. Ends 24*a*, 24*b*, and 24*c* of the posts can be embedded in the material of head 14, or fixed in it by any other known method which is beyond the scope of my invention. Finally, as more clearly seen in FIGS. 2A and 2B, the net or mean diameter (diameter between the lands and the grooves) of the knurled or roughened portion is no greater than the smooth tip portion of each bristle. This is critical because otherwise the bristles would snag in penetrating the narrow passages between the teeth, under bridges etc.

Figure 3:
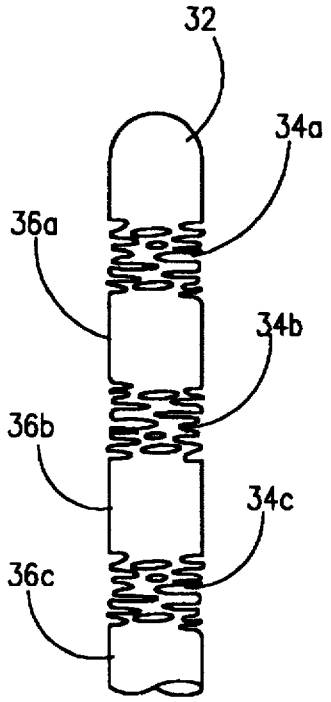
FIG. 3 is a view of a bristle made in accordance with another embodiment of the invention.

Another embodiment of the bristle suitable for the toothbrush of the invention is shown in FIG. 3. In this embodiment a bristle has a smooth tip of the same type and dimensions as in the previous embodiment but, in contrast to the toothbrush of FIGS. 1–2, it has several alternating knurled portions 34*a*, 34*b*, 34*c* and stabilizing portions 36*a*, 36*b*, 36*c*. As with FIGS. 2, 2A, and 2B, the net diameter of the knurled or roughened portions are no greater than the predetermined diameter of the smooth tip portions. The functions of the portions of the bristle and dimensions of grooves and their ratios are the same as in the previous embodiment. As it will be shown later, the arrangement and number of knurled and smooth portions can be easily controlled in the bristle roughening operation.

FIGS. 4 AND 5—DESCRIPTION OF OPERATION OF THE TOOTHBRUSH OF FIGS. 1–3

In a tooth cleaning operation, smooth rounded tips 18*a*, 18*b*, 18*c* . . . easily penetrate spaces between the teeth as well as under crowns, bridges, cavities around the teeth, and other hard-to-get areas. Such penetration occurs without deforming or bending of the bristle tips which is inherent in bristles with continuously roughened surfaces. The rounded shape of tips 18*a*, 18*b*, 18*c* . . . makes it possible to penetrate extremely narrow spaces. Under the force of the user's hand applied to brush handle 12, bristles 16 penetrate further into the target area, e.g., space S (FIG. 4) between teeth T1 and T2 without bending. This is possible due to the high rigidity of bristles 16 imparted to them by strong stabilizing posts 22a, 22b, 22c . . . . As mentioned above, the posts have intact smooth surfaces which are absent in completely roughened bristles. The improved rigidity of bristles ensures reliable removal of food particles F1, F2, etc., which are entrapped between the bristles and are thus removed from the position between teeth T1 and T2 or from the cavities.

In tooth cleaning, roughened or knurled portions 20a, 20b, 20c . . . produce a scraping effect which facilitates removal of tartar, food particles, bacteria colonies, etc. from the teeth surfaces or from the spaces between teeth or cavities. Penetration of the knurled portions deeper to the hard-to-get areas is facilitated due to the provision of smooth rounded tips 18a, 18b, 18c . . . and, the unique and critical feature that the net diameter of the knurled or roughened portions of the bristles is no greater than the diameter of the smooth portions thereof. Since knurled portions 20a, 20b, 20c . . . have intact areas or projections 28a, 28b, 28c . . . between grooves 26a, 26b, 26c . . . , the serrated portions of the bristles maintain their initial rigidity combined with an efficient tooth cleaning action provided by the scraping effect of edges of grooves 26a, 26b, 26c.

Figure 4:
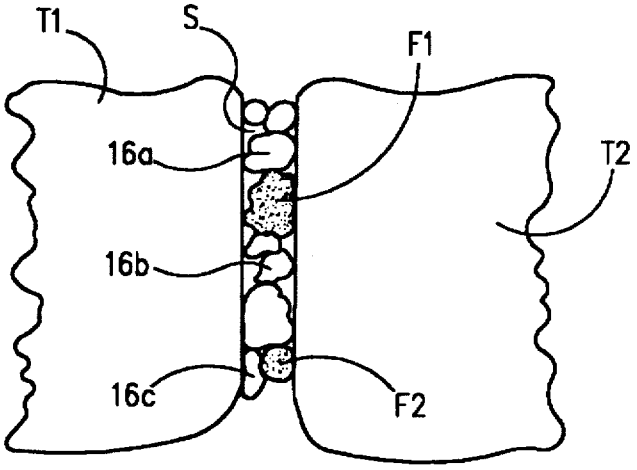
FIG. 4 is a view illustrating the position of the bristles of the invention in removing a food particle entrapped between the teeth.

As shown in FIG. 4 (which is a view illustrating positions of the bristles in removing a food particle entrapped between the teeth), a food particle F1 which is entrapped between two adjacent teeth T1 and T2 is caught between bristles 16a, 16b, 16c . . . and is removed from space S.

Figure 4A:
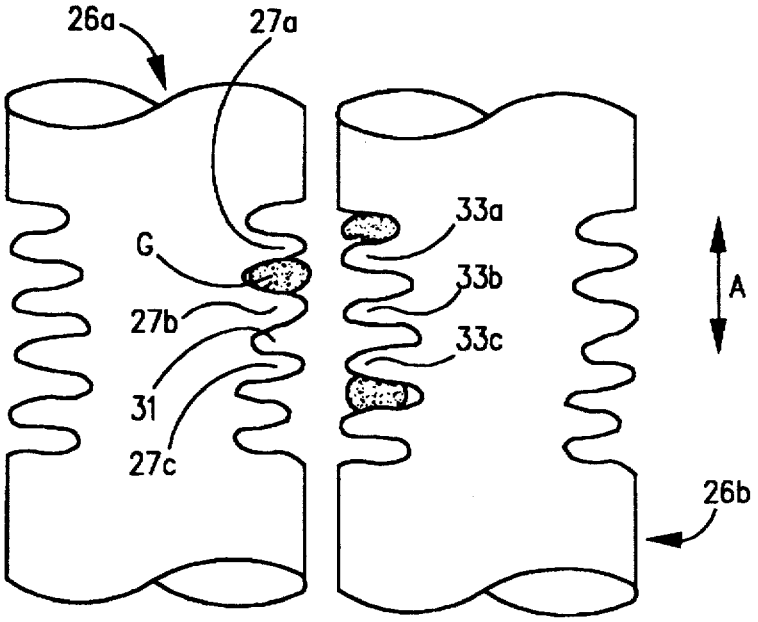
FIG. 4A is a view illustrating the self-cleaning effect of the bristles with projections.

In bristles of the type shown in FIG. 2B with long projections 27a, 27b, 27c . . . . , the back-and-forth movements of toothbrushing causes alternating inclinations of projections 27a, 27b, 27c in the direction of arrows A (FIG. 4A), so that even microscopic food particles of food, tartar or bacteria colonies G which adhere to the surface of the teeth can be entrapped in pockets 31 formed between projections 27a, 27b. During the alternating inclinations projections 27a, 27b, 27c . . . form imbrications which keep the entrapped objects. During alternating movements, the entrapped particles of food, etc. are crushed and disintegrated. On the other hand, the interaction between the projections of adjacent bristles produces a self-cleaning effect which is shown in FIG. 4A. It can be seen that imbricated projections 27a, 27b, 27c . . . of a bristle 26a interact with projections 33a, 33b, 33c . . . of a bristle 26b. As a result of such action, the entrapped disintegrated particles will be removed from the pockets between the projections or disintegrated.

It is understood that the case of bristles with projections is also applicable to the embodiment shown in FIG. 3. In other words, each knurled portion 36a, 36b, 36c may have projections 27a, 27b, 27c . . . . Alternatingly, some of the knurled portions may have serrations and others may have projections.

FIG. 5

Figure 5:
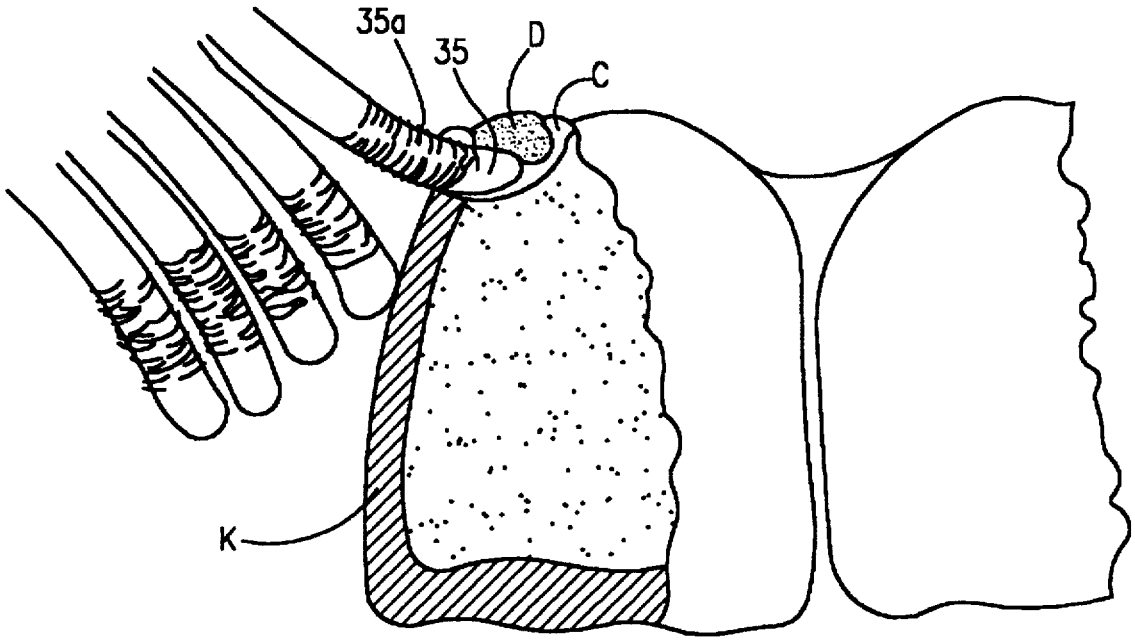
FIG. 5 is, view illustrating the position of the bristle tips penetrating a tooth cavity.

FIG. 5 shows how a smooth rounded tip 35 penetrates a closed and hard-to-get-to space C, e.g., under a crown K. Because of its rigidity and firmness, tip 35 guides the rest of the bristle, i.e., a roughened portion 35a into cavity C. Such an action ensures reliable removal of food debris D from cavity C.

METHOD OF MANUFACTURE—FIG. 6

A method of manufacturing the toothbrush of the present invention will now be described.

A main distinguishing feature of the method is that the roughened portions or serrations are formed, not on a continuous filament which is then cut into separated bristles, but rather on a ready-made toothbrush with smooth bristles.

Figure 6:
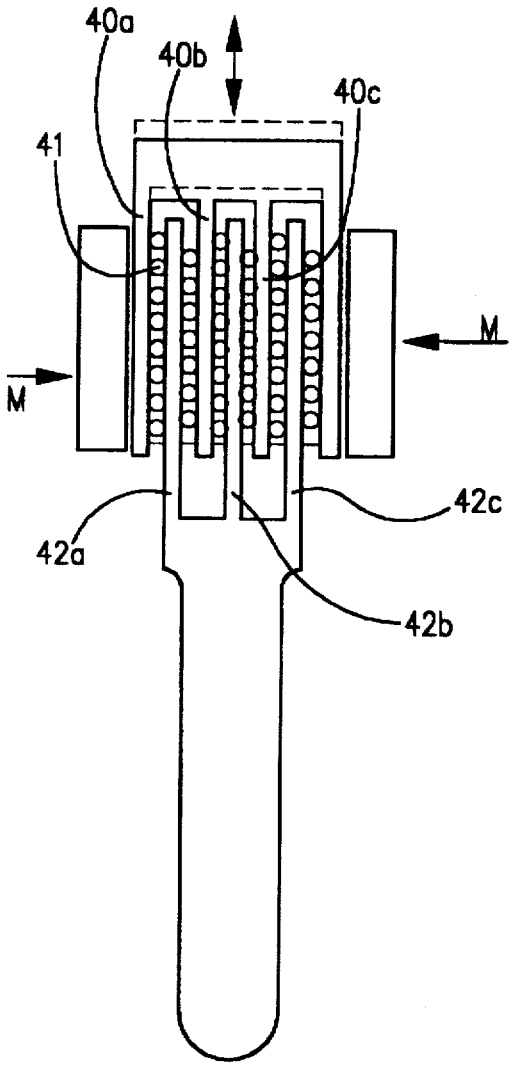
FIG. 6 is a schematic view illustrating a method for manufacturing a toothbrush of the invention, the brush head being shown inserted into the apparatus for knurling by reciprocating moveable dies.
Figure 6A:
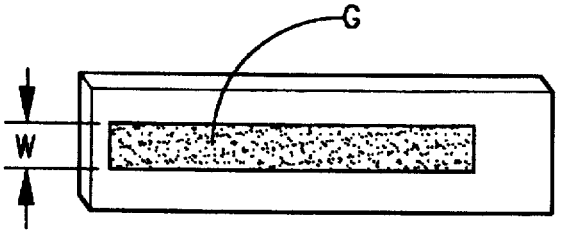
FIG. 6A is a perspective view of a die plate with abrasive grains for forming grooves on the surface of the bristles by combining reciprocating movements with swinging.

Such a brush is inserted into a working chamber of an apparatus (which is not shown and which is beyond the scope of the present invention) where bristles 16 (FIG. 6) are squeezed between die plates 40a, 40b, 40c and 42a, 42b, 42c. Die plates 40a, 40b, and 40c are moveable and can reciprocate in the direction of arrow F, and die plates 42a, 42b, and 42c are stationary. The facing surfaces of the die plates have abrasive grains G (FIG. 6A) attached to their surface. FIG. 6A is a perspective view of one of the die plates with abrasive grains G attached, e.g., by a strong synthetic adhesive to one surface of the die plate. The grains can also be embedded into the material of the plates. The grains may be made of diamond or carborundum particles.

The brush head with bristles 41 is squeezed by applying counteracting forces M and M to sides of the brush head, so that abrasive particles are forced to side surfaces of bristles and penetrate their material. In a squeezed state of the brush, moveable die plates 40a, 40b, and 40c reciprocate in the direction of arrow F. This action causes twisting of squeezed bristles 41 with respect to abrasive grains G, whereby circumferential grooves are formed on the bristles.

FIG. 7

Figure 7:
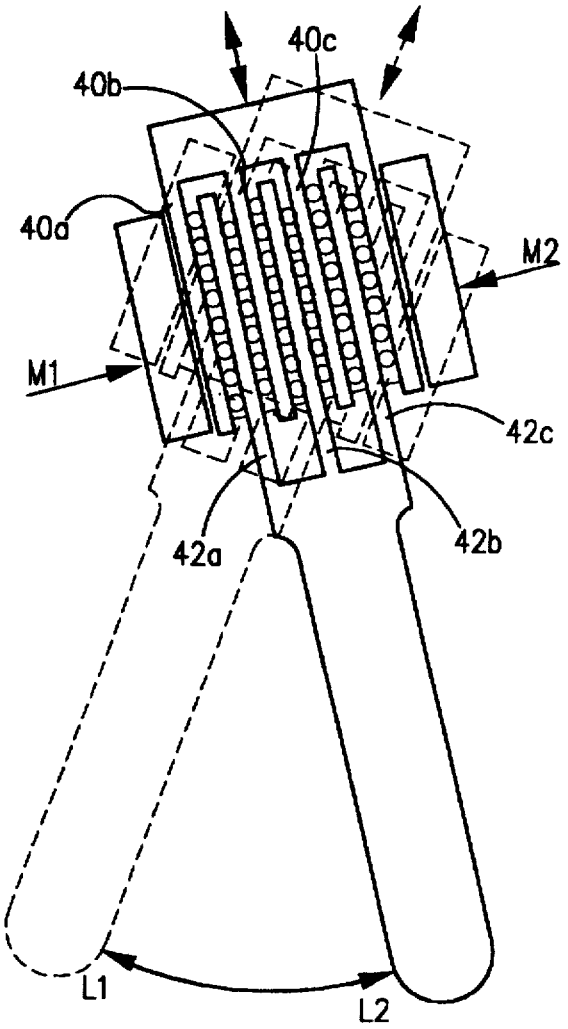
FIG. 7 is a view illustrating a knurling operation for the manufacture of the toothbrush of the invention.

FIG. 7 shows another procedure in which the reciprocations of moveable dies 40a, 40b, and 40c is combined with swinging movements of the brush in the direction of arrows L1 and L2.

More specifically, the head of the brush is rotated back and force in the direction of arrows L1 and L2, whereby the serrations or grooves are cut on the surfaces of the bristles. Because the bristles are grouped into strands and because the abrasive grains are arranged close to each other, rotation of the brush handle will form circumferential grooves of the type shown in FIG. 2A over the entire periphery, but only on the part of the bristle which is designed to be a roughened portion 20a, 20b, 20c . . . . Furthermore, the position of abrasive grains on the die plates may be controlled so that the lengths of smooth tips 18a, 18b, 18c . . . , serrated portions 20a, 20b, 20c . . . , and stabilizing posts 22a, 22b, 22c . . . can be controlled as well. In fact, since the serrations and intact portions of the bristles are formed on a ready-made brush, the entire geometry of the bristled portion of the toothbrush can be easily controlled by using replaceable die plates of different types. In any case, the width W of portions of the die plates with abrasive grains (FIG. 6A) should always be smaller than the length of the entire bristle.

In reality at least part of the bristles will be grooved and some individual bristles may remain ungrooved, but a majority of the bristles will acquire the roughened portions.

Upon completion of the operation, the toothbrush is washed or cleaned with compressed air for the removal of the abrasive particles. After such treatment the toothbrush is ready for use.

FIG. 8

Figure 8:
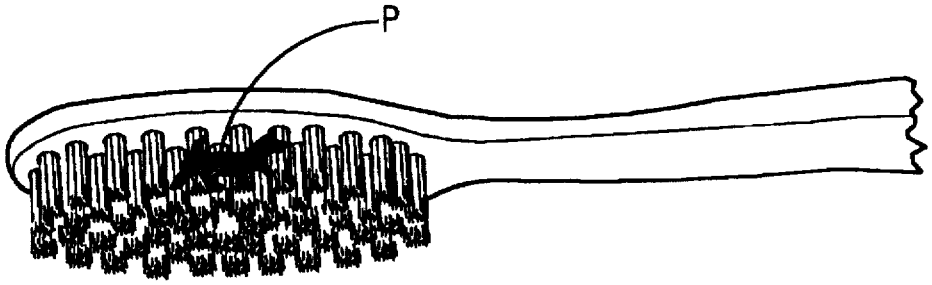
FIG. 8 is a view of a toothbrush of the invention with a color pattern formed on the side surface of the bristled part of the brush.

By replacing the die plates with various patterns of grain-supporting portions it becomes possible to form various patterns P on the sides of the bristled part of the brush. When the head of such a brush is immersed into a food-coloring liquid, pattern P can develop into a visible colored picture of the type shown in FIG. 8. Such a feature makes the toothbrush more attractive for children.

RAMIFICATIONS AND SCOPE

Thus it has been shown that the toothbrush of the invention with partially knurled bristles has an improved tooth cleaning capacity, does not slide over the surfaces of teeth during cleaning, performs cleaning and removal of microscopic tartar-creating bacteria, produces a brushing and scraping effect rather than sweeping, imparts higher rigidity to the bristle tips, facilitates penetration of bristles into cavities between the teeth and underneath the bridges, facilitates cleaning of teeth with braces, is resistant to the loss of bristles after short usage, and has an improved rigidity. Also disclosed is a method for manufacturing toothbrushes with the possibility of controlling functions of different parts of the bristles for more effective cleaning.

Although the toothbrush has been shown and described with reference to specific embodiments, any other modifications and changes are possible, provided that they do not depart from the scope of the attached claims. For example, in the toothbrush shown in the drawing, the free ends of the bristles form a flat surface. However, the free tips of the bristles can form elevated portions, profiled surfaces, etc. The groups of bristles may be arranged into one, two, three, four, or more rows which vary in distance from each other. The bristles themselves may be different in thickness. The bristles can be implanted into the head portion of the toothbrush without being divided into rows, or they may be arranged in circles, etc. The invention is also applicable to any electrical toothbrush or any other mechanical or sonic toothbrush, provided these toothbrushes have head portions with bristles.

The method of manufacturing of the bristles was described with plate dies kept stationary and with the toothbrush head turned back and forth with respect to the stationary die plates. However, the toothbrush with squeezed bristles can be kept stationary and the die plates can be turned back and force for the formation of circumferentially arranged serrations. The serrations may have a helical or vertical direction by combining the swinging motions of the die plates with vertical movements of the brush.

Although the apparatus was shown with the swinging handle for forming circumferential grooves on the bristles, such grooves can be produced without the swinging motion but rather by reciprocating the moveable dies with respect to the stationary dies. This is because in a squeezed state the bristles will be twisted with respect to the abrasive grains. Roughening was illustrated by squeezing the bristles between abrasive grains and by moving the grains with respect to the squeezed bristles. However, the roughened portions can be produced by masking the tips and dipping the brush head into an etching solution, or by using a laser. Smoothing can be done by heating the tips of rough bristles.

Although the invention has been illustrated with reference to a toothbrush, it is understood that the same principle is applicable to any brush, provided it has bristles with smooth tips and partially roughened side surfaces.

Thus the scope of the invention should be determined by the appended claims and their legal equivalents, and not by the examples given.

What I claim is:

1. A toothbrush comprising:

a handle portion, a head portion at one end of said handle portion, said head portion having a plurality of individual bristles having a predetermined diameter extending out from said head portion, each bristle comprising:

a stabilizing post portion which is rigidly attached to and extends out from said head portion, said stabilizing post portion having a peripheral surface which is smooth, a tip portion at an end of said bristle opposite said stabilizing post portion, said tip portion also having a peripheral surface which is smooth, and at least a single intermediate portion between said stabilizing post portion and said tip portion, said intermediate portion having a net diameter no greater than said predetermined diameter of said individual bristles, and having a peripheral surface, which comprises a multitude of adjacent grooves and lands so that said peripheral surface is roughened and more abrasive than said post portion and said tip portion.

2. The toothbrush of claim 1 wherein said grooves and lands extend in a circumferential direction around said bristles.

3. The toothbrush of claim 1 wherein said grooves have depths ranging from 1/10 to 1/3 of the thickness of each bristle.

4. The toothbrush of claim 1 wherein said lands have top edges and said bristles are spaced closely enough so that the edges of some lands of each bristle are in contact with some lands of a plurality of adjacent bristles.

5. The toothbrush of claim 1 wherein said grooves and lands extend in a circumferential direction around each bristle and said grooves have a depth ranging from 1/10 to 1/3 of the thickness of each bristle.

6. The toothbrush of claim 1 wherein, for each bristle, said intermediate portion is about one-quarter to three-quarters of the length of said bristle.

7. The toothbrush of claim 1 wherein, for each bristle, said grooves occupy from 5 percentum to 90 percentum of the surface area of said bristle.

8. The toothbrush of claim 1 wherein said bristles are arranged in tufts.

9. The toothbrush of claim 1 wherein, for each bristle, said intermediate portion has substantially the same diameter as said post portion and said tip portion.

10. The toothbrush of claim 1 wherein each bristle has a plurality of said intermediate portions.

11. A toothbrush comprising:

a handle portion, a head portion having at one end of said handle portion, said head portion having a plurality of individual bristles having a predetermined diameter extending out from said head portion, each bristle comprising:

a stabilizing post portion which is rigidly attached to and extends out from said head portion, said stabilizing post portion having a peripheral surface which is smooth, a roughened portion having a net diameter no greater than said predetermined diameter of said individual bristles, and extending out from said stabilizing post portion, said roughened portion having a peripheral surface, said peripheral surface comprising a multitude of adjacent grooves and lands which cause said peripheral surface to be roughened and more abrasive than said post portion, and a tip portion at an end of said bristle opposite said stabilizing post portion and extending out from said roughened portion and forming a free end of said bristle distal from said head portion, said tip portion also having a peripheral surface which is smooth, and wherein each bristle may have a plurality of said roughened portions.

12. The toothbrush of claim 11 wherein said grooves and lands extend in a circumferential direction around said bristle.

13. The toothbrush of claim 11 wherein said grooves and lands have a depth ranging from 1/10 to 1/3 of the thickness of said bristle.

14. The toothbrush of claim 11 wherein for each bristle, said grooves occupy from 5 percentum to 90 percentum of the surface area of said bristle.

* * * * *